US006178710B1

(12) United States Patent
Colalillo

(10) Patent No.: US 6,178,710 B1
(45) Date of Patent: Jan. 30, 2001

(54) WATER PERMEABLE SLAB INVENTION

(76) Inventor: Louis R. Colalillo, 10 Cutter Mill Rd., Suite 304, Great Neck, NY (US) 11021

( * ) Notice: Under 35 U.S.C. 154(b), the term of this patent shall be extended for 0 days.

(21) Appl. No.: 09/229,405

(22) Filed: Jan. 13, 1999

(51) Int. Cl.[7] ..... E04B 1/16

(52) U.S. Cl. ..... 52/310; 52/241.11; 52/294; 52/302.1; 52/414; 405/36

(58) Field of Search ..... 52/169.1, 741.11, 52/294, 302.1, 302.3, 310, 274, 414, 432; 405/36, 50, 80, 256

(56) References Cited

U.S. PATENT DOCUMENTS

| | | | | |
|---|---|---|---|---|
| 407,500 | * | 7/1889 | Vaughan | 52/169.1 |
| 3,534,561 | * | 10/1970 | Kida | 405/238 |
| 3,778,948 | | 12/1973 | Berthier . | |
| 3,847,630 | | 11/1974 | Compernass et al. . | |
| 3,956,864 | * | 5/1976 | Fung | 52/414 |
| 4,001,990 | * | 1/1977 | Chase et al. | 52/167.4 |
| 4,075,799 | * | 2/1978 | Lemelson | 52/169.5 |
| 4,245,443 | | 1/1981 | Beechen . | |
| 4,265,064 | * | 5/1981 | Parezo | 52/169.5 |
| 4,453,844 | | 6/1984 | Shaw . | |
| 4,578,912 | | 4/1986 | Ericsson . | |
| 4,637,184 | | 1/1987 | Radtke et al. . | |
| 5,156,494 | | 10/1992 | Owens et al. . | |
| 5,630,299 | | 5/1997 | Jackman et al. . | |
| 5,740,638 | * | 4/1998 | Shepherd, III | 52/169.5 |
| 5,768,842 | | 6/1998 | Austin . | |
| 5,771,643 | | 6/1998 | Parker . | |
| 5,775,039 | | 7/1998 | McPherson . | |
| 5,784,838 | | 7/1998 | Phillips . | |
| 6,058,659 | * | 5/2000 | Astrom | 52/34 |

OTHER PUBLICATIONS

"Going Upscale" by Jan Tyler in Sep. 11, 1998 issue of Newsday.

* cited by examiner

*Primary Examiner*—Beth A. Stephan
*Assistant Examiner*—Brian E. Glessner
(74) *Attorney, Agent, or Firm*—Darby & Darby

(57) ABSTRACT

A breathing system for a steel reinforced concrete slab or pile slab allows water to penetrate the slab from both directions, upward and downward, thereby relieving any water pressure differential across the slab. This minimizes stresses on the slab, and maintains the water table. A plurality of apertures are distributed over the surface of the slab, and extend between the upper and lower surfaces. Each aperture may include a pipe. The apertures are evenly spaced apart in between the reinforcing bars, so as not to compromise the strength of the slab. The apertures will allow water to penetrate evenly over the entire surface of the slab. Layers of sand or crushed stone adjacent the upper and lower surfaces convey water to and from the apertures.

20 Claims, 2 Drawing Sheets

WATER PERMEABLE SLAB INVENTION

FIELD OF THE INVENTION

This invention relates to the field of foundation slabs, and more particularly to a system for allowing water to penetrate a concrete slab.

BACKGROUND OF THE INVENTION

Certain construction sites are subject to storm water or tidal flow penetrating the soil. Conventional slab-on-grade or pile-slab structural systems do not allow water to penetrate them. A rising tide will create an upward pressure on the lower surface of the slab. A downward pressure will be exerted by storm water that lies above the slab and cannot drain. The Department of Environmental Conservation in certain flood zone areas requires that any such water be allowed to penetrate the site, including any structure, to maintain and replenish the water table.

Systems that allow water to penetrate a foundation are known and, heretofore, have been configured in different ways. Some examples of foundation drains in the prior art are seen in the following U.S. patents:

Phillips, U.S. Pat. No. 5,784,838; Parker, U.S. Pat. No. 5,771,643; Jackman, U.S. Pat. No. 5,630,299; and Beechen, U.S. Pat. No. 4,245,443; all show a drain unit that extends around the periphery of a basement wall for draining water to beneath the floor.

McPherson, U.S. Pat. No. 5,775,039, depicts a drain that collects water entering between the wall and footing, and conveys the water to a sump under the floor.

Owens, U.S. Pat. No. 5,156,494, illustrates an active system for pumping water to points around the periphery of a foundation to equalize stress upon the foundation.

Compernass, U.S. Pat. No. 3,847,630; and Shaw, U.S. Pat. No. 4,453,844; both disclose porous concrete which is water permeable.

While the above-described systems serve a drainage function, they display serious shortcomings with respect to satisfying the Department of Environmental Conservation requirements. Furthermore, such conventional systems do not relieve the upward and downward water pressure which minimizes stress on the slab. The above-described systems relieve water pressure only on a unidirectional basis, not across the slab. In order to relieve both upward and downward pressure on the slab, while maintaining structural integrity, several conditions must be met. Firstly, water must freely penetrate the slab in both directions: from the upper surface through the slab and out the lower surface, and also in the reverse direction, from the lower surface through the slab and out the upper surface. Secondly, the water must penetrate evenly over the surface of the slab, not just around the perimeter, to relieve pressure over the entire surface area. Thirdly, the slab must not be compromised in strength throughout it's service life. The inventions of Phillips, Parker, Jackman, and Beechen drain water from the upper surface to the lower surface around the perimeter only, not evenly over the surface. McPherson conveys water not from the upper surface, but from only the footing perimeter to the lower surface, and again not evenly over the surface. Owens does not allow water to flow freely in both directions. Owens pumps water to lower surface points only, around the periphery only, and upon demand from stress sensors, not upon demand from the environment. The porous concrete of Compernass and Shaw allow water, including salt water, full access to the reinforcing bars in the concrete. Within a short time, the carbon steel bars will be corroded to a useless condition, weakening the slab and leading to structural failure. Furthermore, the special porous concrete mix is expensive, and may not meet the structural strength requirements of the job.

Accordingly, there is a need to provide a breathing system for concrete slabs that will allow water to penetrate the slab from both directions, upward and downward.

There is a further need to provide a system of the type described and that will allow water to penetrate evenly over the entire surface of the slab.

There is a still further need to provide a system of the type described and that will not compromise the strength of the slab throughout it's service life.

There is a yet further need to provide a system of the type described and that is cost-effective and easy to install.

SUMMARY OF THE INVENTION

In accordance with the present invention, there is provided a breathing system and method for a concrete slab having an upper surface and a lower surface. The breathing system comprises a plurality of apertures distributed over the upper and lower surfaces. Each aperture extends between the upper and lower surfaces. This is to provide fluid communication between the upper and lower surfaces, thereby relieving any water pressure differential in all directions across the slab. There is an upper layer of water permeable material disposed closely adjacent the slab upper surface. There is also a lower layer of water permeable material disposed closely adjacent the slab lower surface. These layers convey water to and from the apertures. The water permeable material is selected from the group consisting of sand and crushed stone.

BRIEF DESCRIPTION OF THE DRAWING

A more complete understanding of the present invention may be obtained from consideration of the following description in conjunction with the drawing, in which.

DESCRIPTION OF THE PREFERRED EMBODIMENTS

Figure 1:
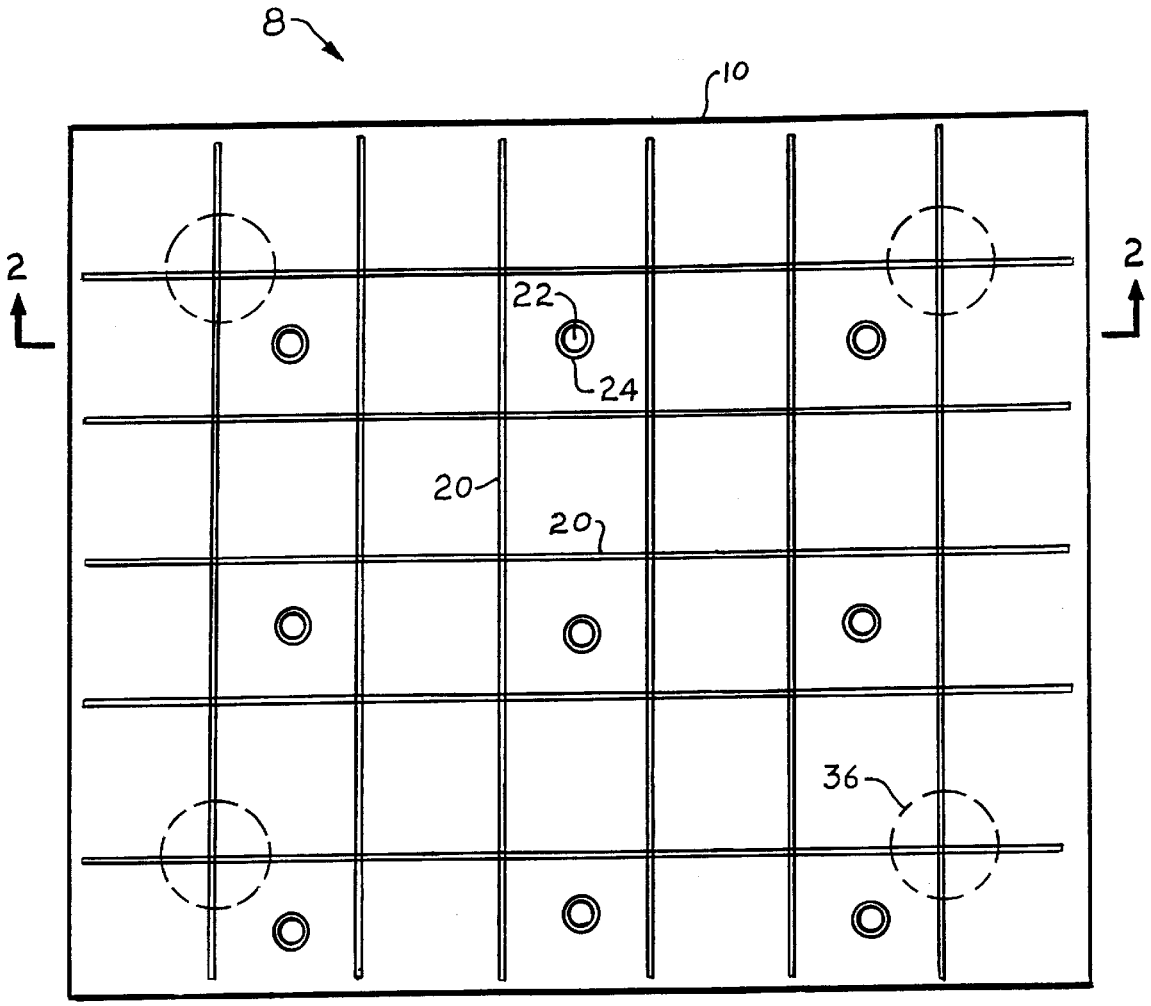
FIG. 1 is a cross-sectional plan view of a breathing system for concrete slabs constructed in accordance with the invention, taken along lines 1—1 of FIG. 2.
Figure 2:
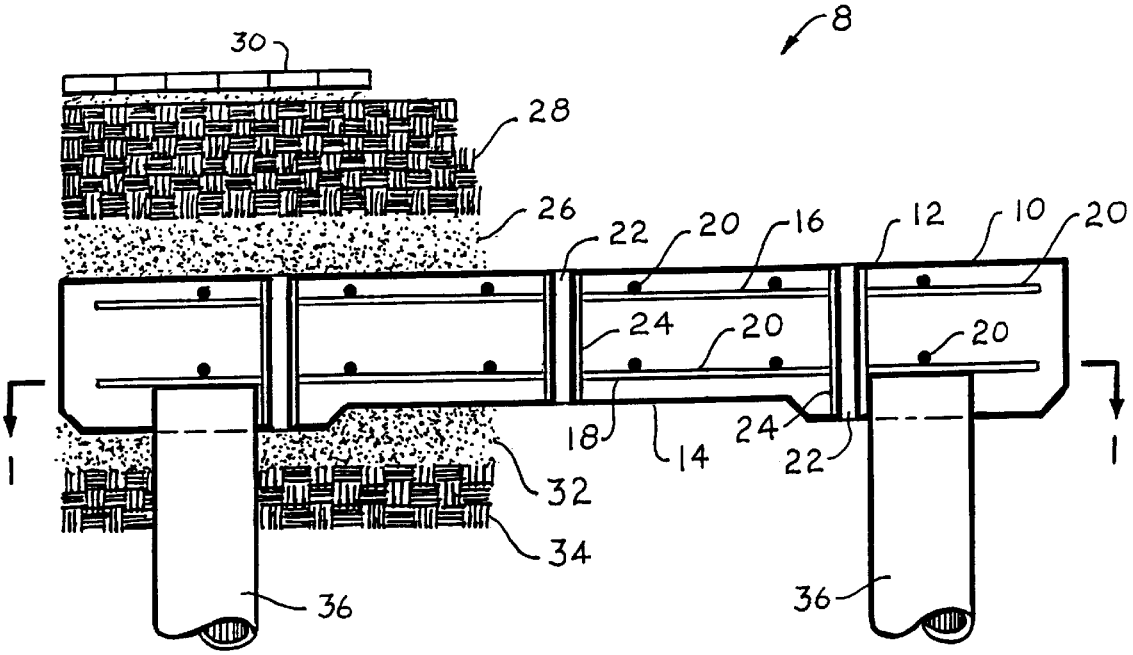
FIG. 2 is a cross-sectional elevational view of the breathing system of FIG. 1, taken along lines 2—2 of FIG. 1.

Referring now to the drawing, a breathing system 8 for a concrete slab 10 having an upper surface 12 and a lower surface 14 is illustrated. The concrete slab 10 has a generally orthogonal grid 16 of reinforcing bars 20 disposed within the concrete slab 10. Typically, the structure will have a second orthogonal grid 18 of reinforcing bars 20 spaced apart from the first as shown in FIG. 2. The breathing system 8 comprises a plurality of apertures 22 distributed over the upper 12 and lower 14 surfaces of the slab 10. Each aperture 22 extends between the upper 12 and lower 14 surfaces, so as to provide fluid communication between the upper 12 and lower 14 surfaces. Any water pressure differential across the slab 10 is thereby relieved. The apertures 22 can be formed in the concrete by a plurality of patterns (not shown), in the shape of tapered plugs positioned in the form, and withdrawn as the concrete cures. Alternatively, each aperture 22 may further comprise a pipe 24 extending between the upper 12 and lower 14 surfaces. The pipes 24 provide forms for casting the apertures 22 in the concrete, and ensure uniform aperture size. The pipes 24 would preferably be made of PVC material, and would be left in the concrete permanently. Note that the apertures according to the invention do not require pipes to function properly. The introduction of PVC (polyvinylchloride) pipes between the reinforcing bars does not compromise structural integrity and creates a homogeneous system for relieving water pressure. The apertures 22 are located between the reinforcing bars 20 so as not to compromise the structural integrity of the concrete slab 10. The apertures 22 are generally evenly spaced apart in a generally orthogonal grid of apertures 22, as shown in FIG. 1. This ensures uniform distribution of the apertures 22 over the entire upper 12 and lower 14 surface areas.

The present invention creates a homogenous system that relieves water pressure across the slab in all directions. The invention allows rising tides to flow through the foundation of the structure (to which the invention is applied) without affecting the structural integrity thereof. According to the breathing system in the invention, a steel reinforced concrete slab allows water to penetrate the slab and pile slab and replenishes the water table thereby relieving water pressure in the slab. Note the loads can be spread and uniformly distributed throughout the surface of the slab.

Referring now to FIG. 2, an upper layer 26 of water permeable material is disposed closely adjacent the slab upper surface 12, so as to convey water to and from the apertures 22. An upper layer of tamped earth 28 typically lies above the upper layer 26 of water permeable material. Covering this will be an uppermost layer of grass or paving stones 30. Likewise, a lower layer 32 of water permeable material is disposed closely adjacent the slab lower surface 14, also to convey water to and from the apertures 22. Below this is a lower layer of tamped earth 34. The water permeable material is selected from the group consisting of sand and crushed stone.

As an option, the concrete slab 10 may further comprise a plurality of piles 36 extending downward from the slab 10 so as to support the slab 10.

Another option according to the invention is to configure vertical water penetrable holes on the walls of the crawl space of the site to allow free water entry and exit. The Department of Environmental Conservation requires that the area surrounding the foundation of the building site must be water permeable. However, it does not require the underneath of the site to be water permeable. The breathing slab can be installed underneath the site to allow water permeability which advantageously protects structural integrity while it further relieves water pressure on the foundation of the site. Note that, according to the invention, PVC pipes are not required when installing the breathing slab underneath the site.

A method is also disclosed for allowing a concrete slab to breathe, the method comprising the steps of:

distributing a plurality of apertures over the upper and lower surfaces;

extending each aperture between the upper and lower surfaces;

communicating fluid between the upper and lower surfaces through the apertures;

relieving any water pressure differential across the slab by the communicating of fluid through the apertures; and locating the apertures between the reinforcing bars so as not to compromise the structural integrity of the concrete slab.

Further steps include:

disposing an upper layer of water permeable material closely adjacent the slab upper surface;

conveying water to and from the apertures through the upper layer of water permreable material;

disposing a lower layer of water permeable material closely adjacent the slab lower surface; and conveying water to and from the apertures through the lower layer of water permeable material.

Still further steps are:

extending a pipe between the upper and lower surfaces at each aperture;

casting the apertures in the concrete by using the pipes as forms; and ensuring uniform aperture size by using the pipes as forms.

A yet further step involves spacing the apertures generally evenly apart in a generally orthogonal grid of apertures.

Numerous modifications and alternative embodiments of the invention will be apparent to those skilled in the art in view of the foregoing description. For example, the apertures 22 are shown as circular in cross-section. It will be appreciated that the apertures 22 can be made square, or any cross-sectional shape, and still fall within the scope of the claims. Note that the apertures are preferably of circular shape because such a shape provides the best geometric structure that is the least obtrusive and allows the most amount of concrete in between the pipes and the reinforcing bars. Accordingly, this description is to be construed as illustrative only and is for the purpose of teaching those skilled in the art the best mode of carrying out the invention. Details of the structure may be varied substantially without departing from the spirit of the invention and the exclusive use of all modifications which will come within the scope of the appended claims is reserved.

I claim:

1. A breathing system for a concrete slab having an upper surface and a lower surface, the breathing system comprising a plurality of apertures distributed over the upper and lower surfaces, each aperture extending between the upper and lower surfaces, so as to provide fluid communication between the upper and lower surfaces, thereby relieving water pressure differential in all directions across the slab, and;

an upper layer of water permeable material disposed closely adjacent the upper surface, so as to convey water to and from the apertures.

2. The breathing system of claim 1, wherein the system is installed underneath a building site.

3. The breathing system of claim 2, wherein the water permeable material is selected from the group consisting of sand and crushed stone.

4. The breathing system of claim 1, further comprising a lower layer of water permeable material disposed closely adjacent the slab lower surface, so as to convey water to and from the apertures.

5. The breathing system of claim 4, wherein the water permeable material is selected from the group consisting of sand and crushed stone.

6. The breathing system of claim 1, wherein each aperture further comprises a pipe extending between the upper and lower surfaces, so as to provide a form for casting the apertures in the concrete, and to ensure uniform aperture size.

7. The breathing system of claim 1, wherein:

the concrete slab further comprises a generally orthogonal grid of reinforcing bars disposed within the concrete slab; and the apertures are located between the reinforcing bars so as not to compromise the structural integrity of the concrete slab.

8. The breathing system of claim 7, wherein the apertures are generally evenly spaced apart in a generally orthogonal grid of apertures.

9. The breathing system of claim 1, wherein the concrete slab further comprises a plurality of piles extending downward from the slab so as to support the slab.

10. A breathing system for a concrete slab having an upper surface and a lower surface, the concrete slab having a generally orthogonal grid of reinforcing bars disposed within the concrete slab, the breathing system comprising:

a plurality of apertures distributed over the upper and lower surfaces, each aperture extending between the upper and lower surfaces, so as to provide fluid communication between the upper and lower surfaces, thereby relieving any water pressure differential across the slab, the apertures being located between the reinforcing bars so as not to compromise the structural integrity of the concrete slab;

an upper layer of water permeable material disposed closely adjacent the slab upper surface, so as to convey water to and from the apertures; and a lower layer of water permeable material disposed closely adjacent the slab lower surface, so as to convey water to and from the apertures.

11. The breathing system of claim 10, wherein the water permeable material is selected from the group consisting of sand and crushed stone.

12. The breathing system of claim 10, wherein each aperture further comprises a pipe extending between the upper and lower surfaces, so as to provide a form for casting the apertures in the concrete, and to ensure uniform aperture size.

13. The breathing system of claim 10, wherein the apertures are generally evenly spaced apart in a generally orthogonal grid of apertures.

14. The breathing system of claim 10, wherein the concrete slab further comprises a plurality of piles extending downward from the slab so as to support the slab and all loads that the slab is subjected to.

15. A method for allowing a concrete slab to breathe, the concrete slab having an upper surface and a lower surface, the concrete slab having a generally orthogonal grid of reinforcing bars disposed within the concrete slab, the method comprising the steps of:

distributing a plurality of apertures over the upper and lower surfaces;

extending each aperture between the upper and lower surfaces;

communicating fluid between the upper and lower surfaces through the apertures;

disposing an upper layer of water permeable material closely adjacent the upper surface;

relieving water pressure differential across the slab by the communicating of fluid through the apertures; and locating the apertures between the reinforcing bars so as not to compromise the structural integrity of the concrete slab.

16. The method of claim 15 further comprising the steps of:

conveying water to and from the apertures through the upper layer of waterpermeable material;

disposing a lower layer of water permeable material closely adjacent the lower surface; and conveying water to and from the apertures through the lower layer of water permeable material.

17. The method of claim 15, further comprising the steps of:

extending a pipe between the upper and lower surfaces at each aperture;

casting the apertures in the concrete by using the pipes as forms; and ensuring uniform aperture size by using the pipes as forms.

18. The method of claim 15, further comprising the step of spacing the apertures generally evenly apart in a generally orthogonal grid of apertures.

19. The method of claim 15 further comprising the step of installing the concrete slab underneath a building site.

20. The breathing system of claim 10 wherein the system is installed underneath a building site.

* * * * *